US006695222B1

(12) United States Patent
Lin

(10) Patent No.: US 6,695,222 B1
(45) Date of Patent: Feb. 24, 2004

(54) DECORATIVE FOUNTAIN

(76) Inventor: Chung-Kuei Lin, 6F-4, No. 1, Wuchuan 1st Rd., Wuku Industrial Dist., Hsinchuang City, Taipei Hsien (TW)

( * ) Notice: Subject to any disclaimer, the term of this patent is extended or adjusted under 35 U.S.C. 154(b) by 0 days.

(21) Appl. No.: 10/456,821

(22) Filed: Jun. 6, 2003

(51) Int. Cl.[7] ..... B05B 17/08

(52) U.S. Cl. ..... 239/17; 239/22; 239/23; 239/211; 239/289; 239/581.1; 239/193; 239/447; 239/436

(58) Field of Search ..... 239/16, 17, 20, 239/22, 23, 193, 211, 289, 569, 581.1, 436, 443, 447

(56) References Cited

U.S. PATENT DOCUMENTS 3,211,378 A * 10/1965 Zysk ..... 239/20
3,432,099 A * 3/1969 Boniecki et al. ..... 239/23
4,413,778 A * 11/1983 Middlemiss ..... 239/17
6,152,381 A * 11/2000 Hones ..... 239/17
6,382,520 B1 * 5/2002 Hones ..... 239/12
6,439,471 B2 * 8/2002 Ehrlich et al. ..... 239/289
6,443,364 B1 * 9/2002 Lin ..... 239/17
6,505,782 B1 * 1/2003 Yen ..... 239/17

* cited by examiner

*Primary Examiner*—Steven J. Ganey
(74) *Attorney, Agent, or Firm*—William E. Pelton, Esq.

(57) ABSTRACT

A decorative fountain includes a hollow body having a recessed area provided with a nappe zone and a shower zone, and a reservoir defined in a bottom portion of the hollow body for receiving therein water. A water pump assembly is received in the reservoir for pumping water in the reservoir to the inlet of the control valve to selectively sprinkle water out of the primary outlet, the secondary outlet or the third outlet. A cover is mounted on top of the hollow body to cover the recessed area and has a controlling knob rotatably mounted inside the cover. Therefore, rotation of the controlling knob is able to control activation of the primary outlet, the secondary outlet and the third outlet to sprinkle water from the reservoir to either the nappe zone or the shower zone.

5 Claims, 6 Drawing Sheets

DECORATIVE FOUNTAIN

BACKGROUND OF THE INVENTION

1. Field of the Invention

The present invention relates to a fountain, and more particularly to a fountain which is able to provide a nappe, a shower and a drizzle with the use of a three-way control valve controlled by a controlling knob.

2. Description of Related Art

An indoor decorative fountain normally has only one water formation, that is, to sprinkle water in a fixed and somewhat boring manner. Perhaps, at first, the single formation of the decorative fountain may still attract an observer's attention for its novel design. However, after a long period of time using the same fountain, the observer may feel tired of watching the same old scene over and over again. Therefore, the fountain may end up in a remote corner and no longer attract any attention, which is quite a waste of money.

To overcome the shortcomings, the present invention tends to provide an improved decorative fountain to mitigate and obviate the aforementioned problems.

SUMMARY OF THE INVENTION

The primary objective of the present invention is to provide an improved fountain having a three-way control valve controlled by a controlling knob to form a three different intensities of water flow so as to provide different scenes to the user.

Another objective of the present invention is that the controlling knob of the three phase fountain can not only control the phase of the water output, but also an audio device received in the cover to match the selected phase.

Other objects, advantages and novel features of the invention will become more apparent from the following detailed description when taken in conjunction with the accompanying drawings.

DETAILED DESCRIPTION OF THE PREFERRED EMBODIMENT

Figure 1:
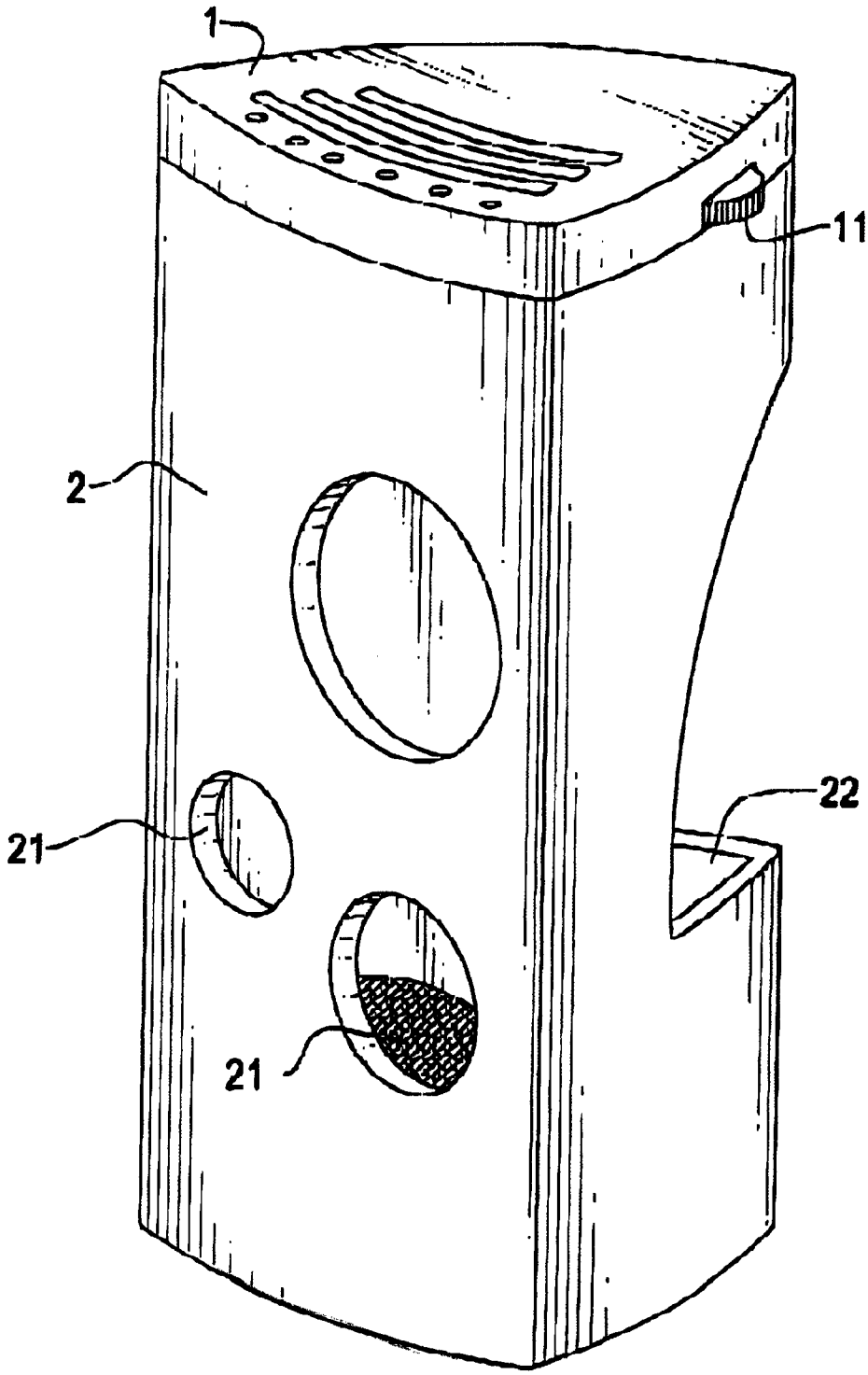
FIG. 1 is a perspective view of the fountain of the present invention.
Figure 2:
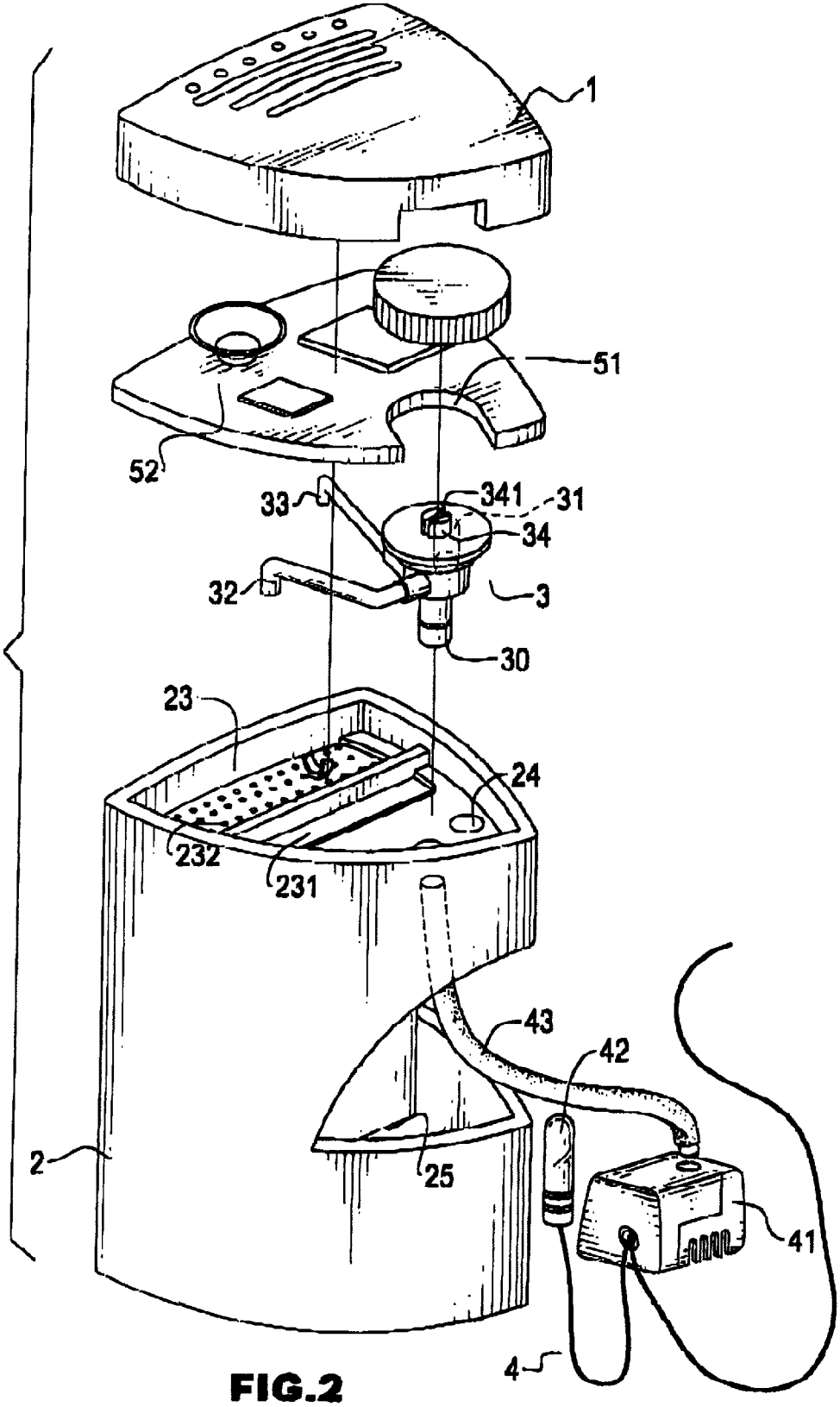
FIG. 2 is an exploded perspective view of the fountain in FIG. 1.

With reference to FIGS. 1 and 2, the three-phase fountain in accordance with the present invention has a cover (1) and a hollow body (2). The cover (1) is detachably connected to a distal end of the body (2) and has a controlling knob (11) rotatably mounted in the cover (1). The body (2) has at least one (three are shown in this embodiment) observation hole (21) defined through a periphery of the body (2) to communicate with an interior of the hollow body (2) and a cutout (22) oppositely defined to the observation hole (21). Preferably, a transparent screen (not shown) is mounted on the observation hole (21) so that observer is able to see an inner face of the hollow body (2).

Further, the body (2) has a recessed area (23) defined therein, wherein the recessed area (23) is divided into a nappe zone (231) and a shower zone (232).

The fountain of the present invention has a three-way control valve (3) which is controlled by the controlling knob (11). The three-way control valve (3) includes an inlet (30), a master outlet (31), a secondary outlet (32) and a third outlet (33). A boss (34) is formed on top of the three-way control valve (3) and has a slit (341) centrally defined in the boss (34). A water pump assembly (4) is received in the hollow body (2) from the cutout (22) and includes a pump (41), an indicator (42) (preferably a light) electrically connected to the pump (41) and extending through a hole (24) in the recessed area (23) to indicate on/off statuses of the fountain, and a hose (43) having a first end in communication with the pump (41) and a second end extending through the recessed area (23) to correspond to the inlet (30) of the three-way control valve (3). A reservoir (25) is defined in a bottom of the hollow body (2) to receive therein water.

Further, a circuit board (5) is sandwiched between the cover (1) and the three way control valve (3). The circuit board (5) has a controlling hole (51) defined to correspond to the controlling knob (11) in the cover (1) and an audio device (52) securely mounted on the circuit board (5) and operably connected to the controlling knob (11) so that the audio device (52) is able to be controlled by the controlling knob (11). Because using a knob to control an audio device to modify sounds is conventional in the art and can be easily achieved by those skilled in the art, detailed description thereof is omitted.

When the three-phase fountain of the present invention is in assembly, the water pump assembly (4) in received in the reservoir (25) of the hollow body (2) from the cutout (22). The indicator (42) is inserted into the hole (24) to show the status of the fountain, and the hose (43) communicates the pump (41) to the inlet (30) of the three-way control valve (3).

Figure 3:
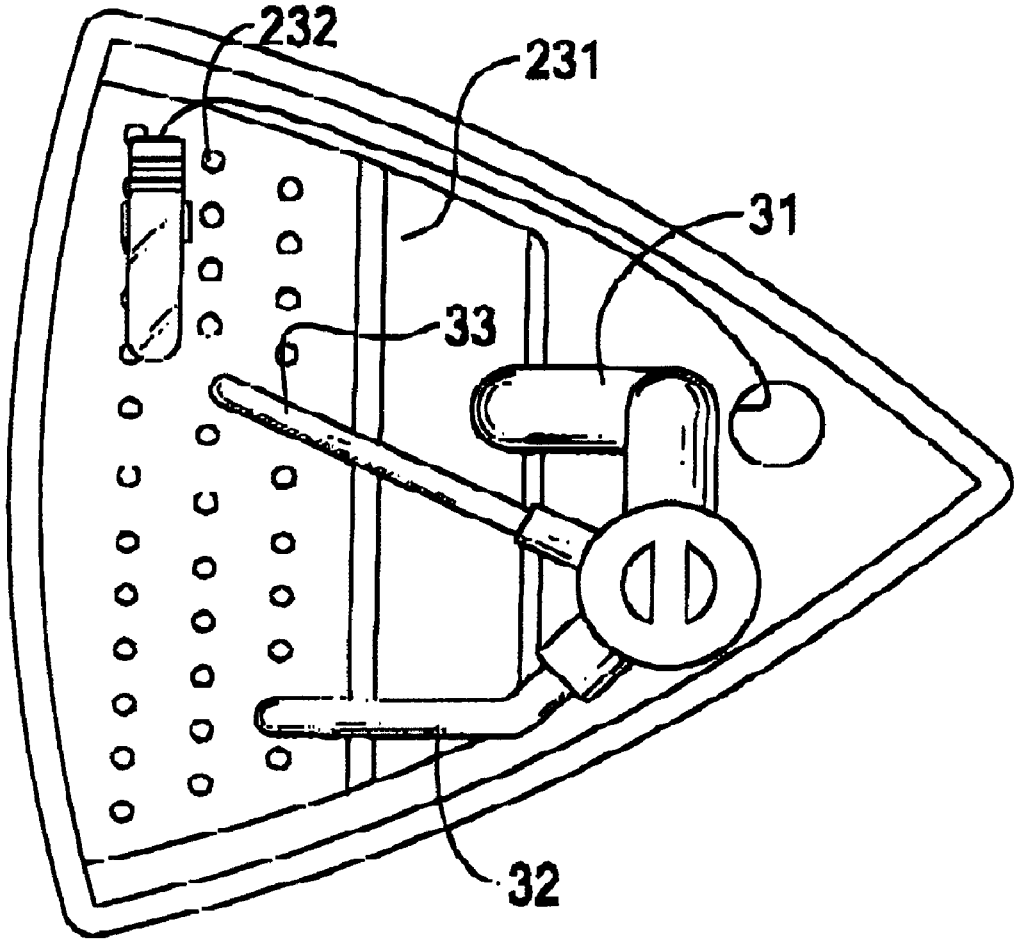
FIG. 3 is a top view of the fountain with the cover removed to show the position of the three-way control valve incorporated with the different zones in the body.

With reference to FIG. 3, it is noted that the primary outlet (31) of the three-way control valve (3) corresponds to the nappe zone (231), the secondary outlet (32) and the third outlet (33) correspond to the shower zone (232).

Figure 4:
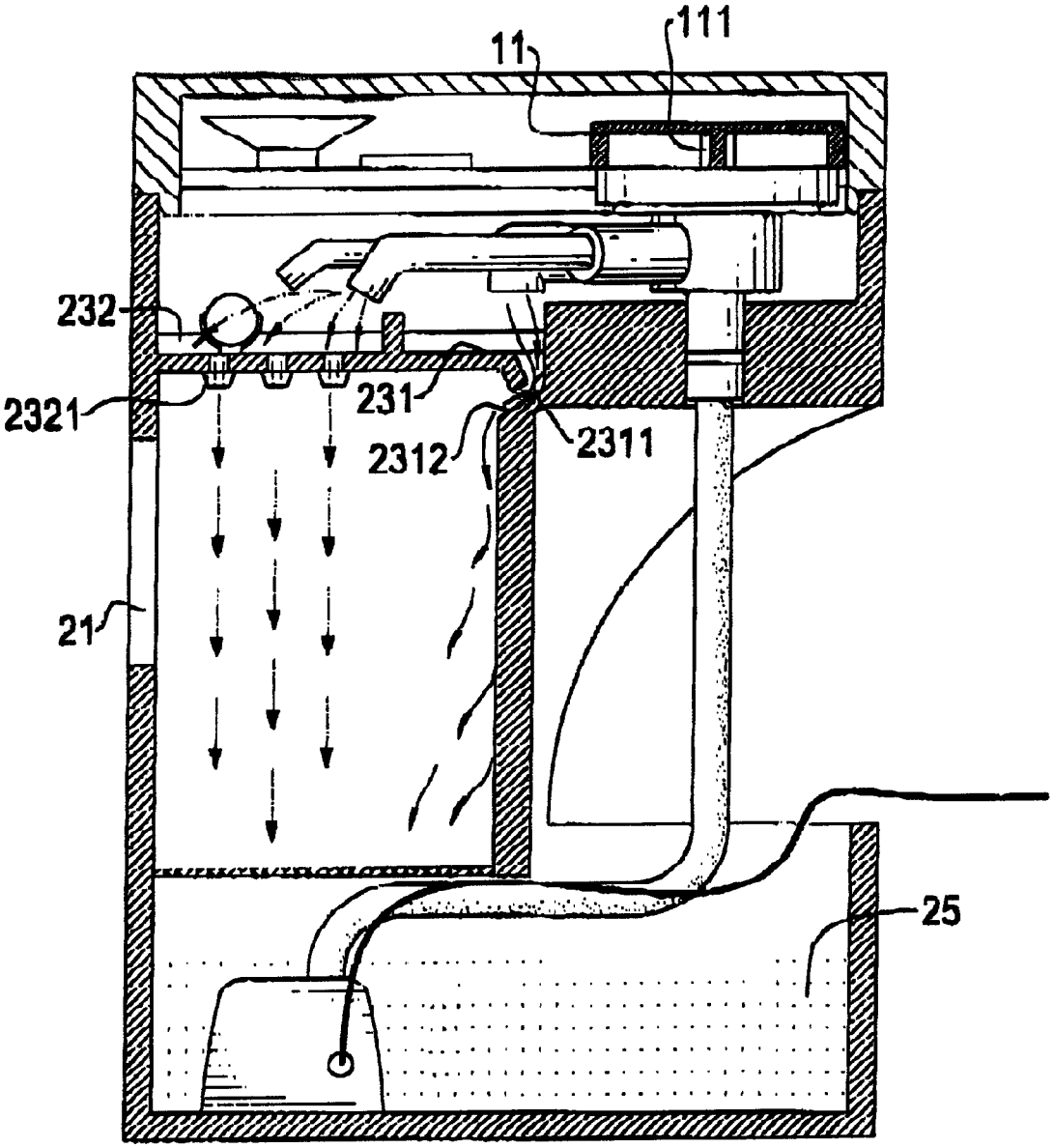
FIG. 4 is a schematic side view showing that water is pumped from the reservoir to the three way valve to sprinkle in different zones.

With reference to FIG. 4 after the assembly of the fountain of the present invention, it is noted that the primary outlet (31) corresponds to a shoulder (2311) formed on the nappe zone (231). A gap (2312) is defined between the shoulder (2311) and the nappe zone (231) to communicate with the interior of the hollow body (2), especially the reservoir (25). The shower zone (232) has multiple apertures (2321) defined through the shower zone (232) to communicate with the reservoir (25). Furthermore, the controlling knob (11) has an extension (111) corresponding to the slit (341) of the boss (34) on top of the three-way control valve (3) such that rotation of the controlling knob (11) is able to control the activation of one of the primary outlet (31), the secondary outlet (32) and the third outlet (33) to sprinkle water through the gap (2312) or the apertures (2321). That is, when the primary outlet (31) is in communication with the hose (43) by the control of the controlling knob (11), water pumped upward by the pump (41) from the reservoir (25) flows out from the gap (2312) and back to the reservoir (25) again to complete a cycle, when the secondary outlet (32) or the third outlet (33) is in communication with the hose (43), water pumped upward by the pump (41) from the reservoir (25) flows nut from either the secondary outlet (31) or the third outlet (31) depending on the control of the controlling knob (11) and back to the reservoir (25) again to complete a cycle.

Figure 5:
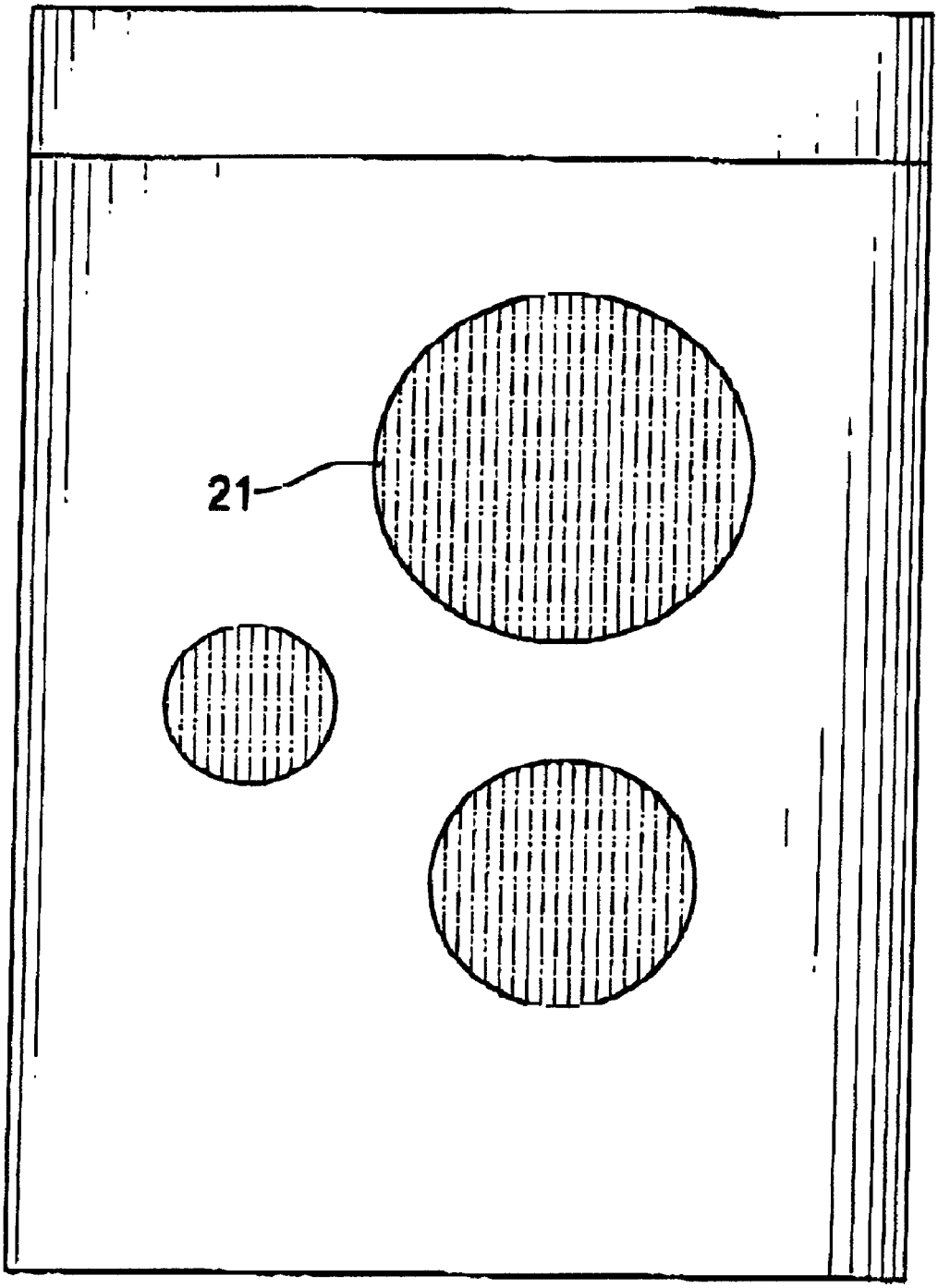
FIG. 5 is a schematic view showing the picture on an inner side wall of the body is seen from the showering effect of the fountain of the present invention.
Figure 6:
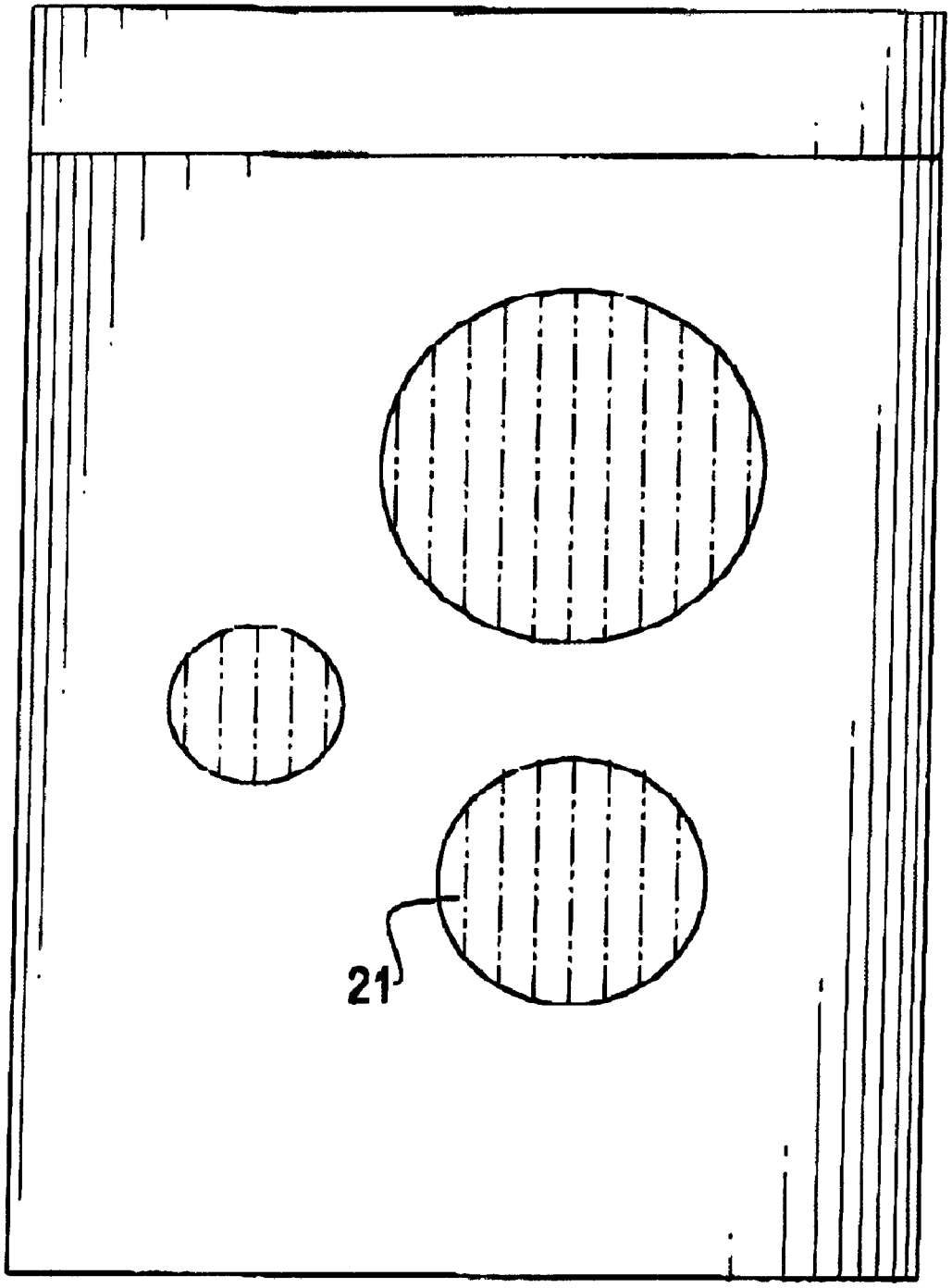
FIG. 6 is a schematic view showing the picture on the inner side wall of the body is seen from the drizzling effect of the fountain of the present invention.

With reference to FIGS. 5 and 6 and taking FIG. 3 for reference, it is noted that the primary outlet (31) has a dimension larger than those of the secondary outlet (32) and the third outlet (33) and the secondary outlet (32) has a dimension larger than that of the third outlet (33). Therefore, the primary outlet (31) has a largest dimension, the secondary outlet (32) has a medium dimension and the third outlet (33) has a smallest dimension. When water from the reservoir (25) flows out of the primary outlet (31), a nappe is formed along a side wall of the gap (2312) (as shown in FIG. 4). When water from the reservoir (25) flows out of the secondary outlet (32), a shower is formed as shown in FIG. 5. However, due to the smallest dimension of the third outlet (33), when water flows out of the third outlet (33), a drizzle is formed as shown in FIG. 6. Due to the density difference between shower and drizzle, a picture on the inner face of the hollow body (2) is vague in different degrees. Meanwhile, when) the operator is using the controlling knob (11) to control the communication between the hose (43) and one of the primary outlet (31), the secondary outlet (32) and the third outlet (33), the audio device (52) on the circuit board (5) is also controlled to match the selected phase. That is, the audio device (52) is able to play music according to the selected phase to increase the surrounding romantic atmosphere.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative fountain comprising:

a hollow body having a recessed area formed on a top portion of the hollow body and provided with a nappe zone and a shower zone, the nappe zone having a gap defined in a bottom face defining the recessed area to communicate with an interior of the hollow body and the shower zone having apertures defined in the bottom face defining the recessed area to communicate with the interior of the hollow body, a reservoir defined in a bottom portion of the hollow body for receiving therein water;

a cover mounted on top of the hollow body to cover the recessed area and having a controlling knob rotatably mounted inside the cover;

a control valve operably connected to the controlling knob and having an inlet securely mounted on and extended through a bottom face defining the recessed area, a primary outlet corresponding to the gap of the nappe zone, a secondary outlet and a third outlet both corresponding to the shower zone such that rotation of the controlling knob is able to control activation of one of the primary outlet, the secondary outlet and the third outlet to sprinkle water from the reservoir to either the nappe zone or the shower zone; and a water pump assembly received in the reservoir for pumping water in the reservoir to the inlet of the three-way control valve to selectively sprinkle water out of the primary outlet, the secondary outlet or the third outlet.

2. The decorative fountain as claimed in claim 1, wherein the control valve has a boss formed on a top of the control valve and having a slit centrally defined in the boss to correspond to an extension formed on a bottom face of the controlling knob so that the rotation of the controlling knob is able to activate communication between the water pump assembly and one of the primary outlet, the secondary outlet and the third outlet.

3. The decorative fountain as claimed in claim 2, wherein the water pump assembly has a pump received in the reseivoir for pumping water upward to the control valve and a hose in communication with the pump and the inlet of the control valve.

4. The decorative fountain as claimed in claim 3 further having a circuit board securely received in the cover and having a controlling hole defined to correspond to the extension of the controlling knob to allow the extension to extend to engage with the boss and an audio device operably connected to the controlling knob for playing music according to the communication between the hose and the control valve.

5. The decorative fountain as claimed in claim 2 further having a circuit board securely received in the cover and having a controlling hole defined to correspond to the extension of the controlling knob to allow the extension to extend to engage with the boss and an audio device operably connected to the controlling knob for playing music according to the communication between the water pump assembly and the control valve.

* * * * *